US005335620A

United States Patent [19]

Small

[11] Patent Number: 5,335,620

[45] Date of Patent: Aug. 9, 1994

[54] PROTECTIVE FAIRING FOR UNDERWATER SENSOR LINE ARRAY

[75] Inventor: David C. Small, Long Beach, Miss.

[73] Assignee: The United States of America as represented by the Secretary of the Navy, Washington, D.C.

[21] Appl. No.: 41,018

[22] Filed: Mar. 31, 1993

[51] Int. Cl.[5] ..... B63B 21/00

[52] U.S. Cl. ..... 114/243; 114/253; 114/244

[58] Field of Search ..... 114/243, 253, 242, 254, 114/244, 245, 251; 367/15-17, 141, 106; 174/101.5, 47

[56] References Cited

U.S. PATENT DOCUMENTS 3,304,364 2/1967 Hetherington ..... 174/101.5
3,343,516 9/1967 Nichols et al. ..... 114/235
3,859,949 1/1975 Toussaint et al. ..... 114/235 F
4,033,279 7/1977 Stiles ..... 114/243
4,365,574 12/1982 Norminton ..... 114/243
4,542,708 9/1985 Holcombe et al. ..... 114/243
4,726,314 2/1988 Ayers ..... 114/243

*Primary Examiner*—Edwin L. Swinehart
*Attorney, Agent, or Firm*—Thomas E. McDonald; William F. McCarthy

[57] ABSTRACT

Protective fairings which can be easily added to existing unfaired underwater sensor line arrays or incorporated into new faired underwater sensor line arrays to provide shock and impact protection to array sensors and cables without degradation of sensor output and allow the line array to be repeatedly raised and lowered under tension from a ship and stored on the ship without disassembly.

20 Claims, 17 Drawing Sheets

PROTECTIVE FAIRING FOR UNDERWATER SENSOR LINE ARRAY

BACKGROUND OF THE INVENTION

1. Technical Field

The invention relates generally to underwater cable fairings, and in particular to a protective fairing for an underwater sensor line array.

2. Background Art

U.S. Pat. No. 3,343,516, which issued on Sep. 26, 1967, to D. A. Nichols et al, describes a towline for the towing of a submerged object, such as a sonar device, from a ship. The towline includes a flexible strength member, e.g., a steel wire rope, carrying a plurality of streamlined fairing sections and a stretchable electrical cable passing through the fairing sections and extending along the strength member to the sonar device. The ship has a rotatable drum upon which the towline is wound for storage. The fairing sections prevents vibration of the strength member as the sonar device is towed at various speeds and provides protection, both in the water and on the ship, for the electrical cable.

U.S. Pat. No. 3,304,364, which issued on Feb. 14, 1967, to A. C. Hetherington, describes a towline for towing a submerged object, such as a sonar device, behind a parent towing vessel, one end of the towline being connected to the submerged object and the other end being secured to the parent towing vessel by a take-up winding drum. The towline includes an elongated body portion of resilient material having an outer transverse cross section which is streamlined in general appearance to prevent lateral whipping of the towline and to provide minimum drag and insure depth control. The resilient body portion houses a continuous non-stretchable tension member, such as a steel wire rope, as well as a continuous assembly of yieldable electrical conductors.

U.S. Pat. No. 3,859,949, which issued on Jan. 14, 1975, to Toussaint et al, describes jacketing for underwater cables and drag ropes, with streamline profile, comprising two completely separable profiled strips for individual reeling, the two strips being snapped together, with joints only at the leading and trailing edges of the profile. Each strip has a recess which mutually cover each other upon assembly and define an elongated cavity for loosely receiving the rope or cable. The two strips may also define limited space cavities for receiving pieces of equipment, such as measuring transducers.

A common technique for constructing an undersea hydrophone line array is to attach a series of hydrophones to the side of a specially designed electromechanical cable. The electromechanical cable is typically composed of a central core of individually insulated electrical conductors which are over-braided with KEVLAR fibers for strength and DACRON fibers for abrasion resistance. The individual conductors to be connected to a particular hydrophone are cut, the ends of these conductors extracted through the outer covering at the desired location for that hydrophone, and waterproof electrical connectors applied to the conductor ends as necessary for mating with the hydrophones. A protective housing for the hydrophone is affixed to the outer surface of the electromechanical cable by any of various connection devices such as clamps, cords or tape for underwater use. The hydrophone is inserted into its protective housing, the electrical connectors are mated, and any excess wiring to the hydrophone secured within the protective housing.

Typically, the hydrophone line array may be one hundred meters or more in length, and may include a hundred or more hydrophones and several other sensors, e.g., tilt, magnetic heading, and pressure sensors, which are connected to respective conductors of the electromechanical cable in the same manner as described above. In many applications, the hydrophone line array is connected to the surface ship by a long cable having a length of one thousand meters or more, so that the hydrophone line array can be deployed in very deep water. For this reason, the electromechanical cable usually includes electrical conductors for telemeter signals and a telemeter signal generating apparatus is disposed at the lower end of the hydrophone line array, so that the signals from the hydrophones are supplied to the nearby telemeter signal generating apparatus which converts the hydrophone signals into telemeter signals for transmission to the surface ship.

In certain applications, the hydrophone array cable passes off the deck of a ship into the water with little applied tension, is detached from the ship and descends to the ocean bottom where data is collected, and is then released from its mooring and floats to the sea surface. In such applications, the array cable is recovered with little potential of damage to the cable or hydrophones due to handling. In other applications, the hydrophone array must be repeatedly lowered and raised over the side of the ship while under considerable tension. This is accomplished by driving the cable onto or off a winch and over a sheave suspended over the side of the ship. As the hydrophones in their protective housings pass over the sheave or onto the winch, they must be aligned such that they are not pinched between the load-bearing cable and the rotating surface of the sheave or winch. If this is not ensured, damage to the housings, hydrophones, cable pig tails, or the electromechanical cable may result. For example, in the past, the hydrophone protective housings have been crushed and ripped from their fastenings to the electromechanical cable, and the unprotected conductor leads have been pinched and cut, causing water intrusion. When such damage occurs in a line array having many hydrophones or other sensors, e.g., eighty or ninety, the repair of such damage can be very costly and time-consuming.

SUMMARY OF THE INVENTION

It is a primary purpose of the invention to provide a protective fairing for an undersea sensor line array to ensure that all hydrophones and other sensors of the array are aligned radially outward from the rotating surfaces of sheaves and winches utilized to deploy, rewind, and store the array.

It is a further purpose of the invention for the protective fairing for an undersea sensor line array to provide shock and impact protection for the array sensors and to provide abrasion and cut resistance for the electromechanical cable of the array.

It is a still further purpose of the invention for the protective fairing for an undersea sensor line array to provide quiet acoustic performance in high current or drift environments.

It is an additional purpose of the invention to provide such a protective fairing for an undersea sensor line array which is easily and quickly added to an existing undersea sensor line array.

It is another primary purpose of the invention to provide a faired undersea sensor line array which can be repeatedly used and stored without disassembly and which ensures that all hydrophones and other sensors of the array are aligned radially outward from the rotating surfaces of sheaves and winches utilized to deploy, rewind, and store the array.

In one embodiment of the invention, a protective jacket or fairing is applied to an existing undersea sensor line array which includes an electromechanical cable and a plurality of hydrophones or other sensors affixed to the cable and connected to respective electrical conductors of the cable. The protective fairing is constructed as a long continuous extrusion of plastic material of such cross section that it may be folded around the cable and the sensors carried by the cable and fastened at the joining edge. The fairing has a hydrodynamically smooth, faired outer surface shape. The assembled fairing defines a first longitudinal cavity with a circular cross section in the leading edge or "nose" through which the electromechanical cable extends and is affixed therein. The assembled fairing also defines a second longitudinal cavity with an oblate cross section which is located behind and adjacent the first cavity, for receiving hydrophones protected by a cylindrical housing affixed to the cable and other sensors. Openings between the first and second cavities will depend on how the hydrophones and other sensors are affixed to the cable. The protective fairing has periodic cutouts along its length for stress relief during bending in the plane of the major diameter. The interiors of the trailing edge halves of the fairing have interlocking fingers which mate and secure the fairing halves into a closed unit. The fingers may be augmented with, or replaced by, adhesive or screw fasteners.

A second embodiment of the invention is a faired undersea sensor line array, which is similar to the first embodiment except that hydrophones and other sensors do not require individual protective housings, and the hydrophones and other sensors are affixed to the protective fairing within the second cavity. For example, a hydrophone may have a cylindrical casing having two studs extending in opposite directions from the cylindrical side of the hydrophone casing into matching holes punched through the fairing, to secure the hydrophone to the fairing.

A third embodiment of the invention is a faired undersea sensor line array, which is similar to the second embodiment except the array support element is an electromechanical cable which includes a coaxial telemetry cable connected between a telemeter signal generating apparatus at the lower end of the array and a surface ship. The telemetry cable is overbraided with KEVLAR fibers or the like to provide mechanical strength to support the array. The hydrophones and other array sensors are connected to the telemeter signal generating apparatus by individually-insulated electrical conductors which may be loose or may be formed into an array sensor cable. Since there are no electrical connections to the telemetry cable along the length of the line array, the electromechanical cable can be embedded in the protective fairing to become an integral part of it when the fairing is manufactured.

BRIEF DESCRIPTION OF THE DRAWINGS

The invention will be better understood, and further objects, features and advantages of the invention will become readily apparent from the following description of the preferred embodiments, taken in conjunction with the accompanying drawings in which.

DESCRIPTION OF PREFERRED EMBODIMENTS

Figure 1:
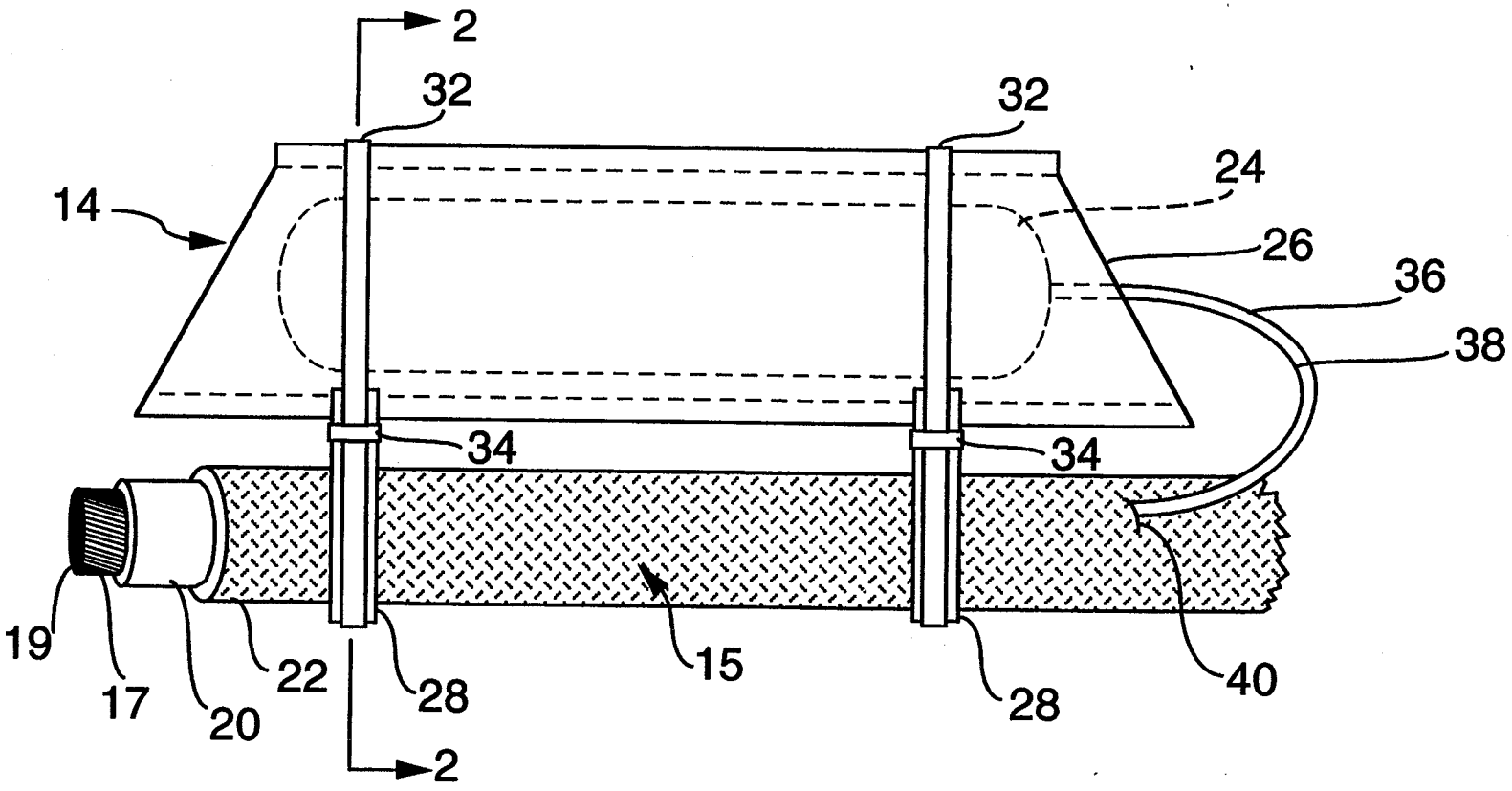
FIG. 1 is a side view of a portion of an unfaired undersea hydrophone line array, showing one of the hydrophones of the array mounted on an electromechanical cable of the array.
Figure 2:
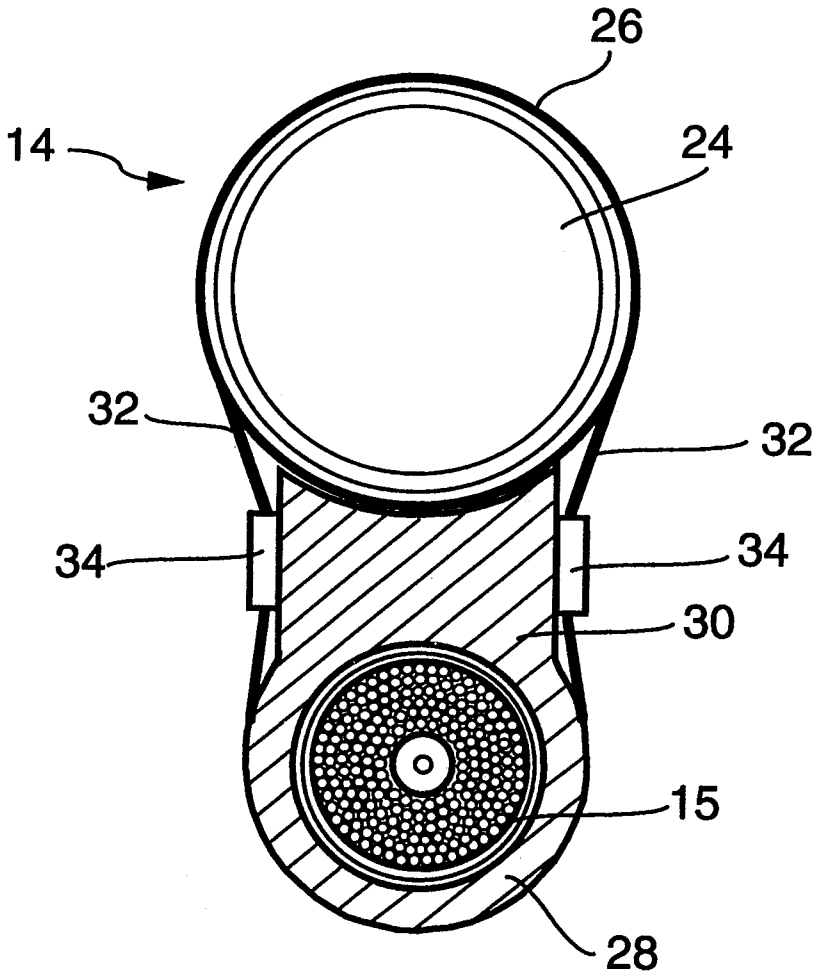
FIG. 2 is a cross section view of the unfaired undersea hydrophone line array of FIG. 1, taken along the line 2—2 of FIG. 1.

The unfaired hydrophone line array 14 shown in FIGS. 1 and 2 includes an electromechanical cable 15 having a center core 17 of individually insulated electrical conductors 19. The center core 17 is over-braided with KEVLAR® fibers 20 for strength and DACRON® fibers 22 for abrasion resistance. The hydrophone line array may include approximately 100 hydrophones 24 as well as several small sensors, such as tilt sensors, pressure sensors or temperature sensors (not shown), with all sensors being affixed to the same side of the cable 15 so that when the line array 14 is wound upon a take-up reel, all of the sensors are disposed radially outward from the cable 15.

The hydrophone 24 shown in FIGS. 1 and 2 is disposed within and affixed to a tubular protective housing 26. The protective housing 26 is spaced from the cable 15 by two cable collars 28 of resilient plastic material which are molded around the cable 12. Each collar 28 includes a raised saddle portion 30 which is curved to match and engage the tubular protective housing 26. A first banding strap 32, extending about the collar 28 and the protective housing 26, is tightened by a second banding strap 34 extending orthogonally about the first banding strap and the saddle portion 30 of the collar 28 to hold the housing 26 tightly against the saddle portion 30 of the cable collar 28.

The hydrophone 24 is electrically connected to two electrically-insulated electrical conductors 36 and 38 of the cable center core conductors 19, which have been extracted from the cable 15 through a cut or opening 40 made in the outer braided layers 20, 22 of the cable 17. The two conductors 36 and 38 have been cut, and the source ends of the conductors 36 and 38 have been electrically connected to the hydrophone 24. Waterproof electrical connectors (not shown) may be applied to the source ends of the two conductors 36 and 38 as necessary for mating with the hydrophone 24.

Both ends of the tubular protective housing 26 are slanted inward from the edge of the housing 26 closest to the cable 12, so that, for small misalignments during deployment or take-up of the hydrophone line array 10, the housing 26 will progressively engage with one side of a take-up sheave to rotate the hydrophone line array 14 to its correct alignment. However, many of these hydrophone protective housings 26 have still been crushed or ripped from their cable fastenings when the hydrophone line array 14 is lowered or raised over the side of a ship under tension.

Figure 3:
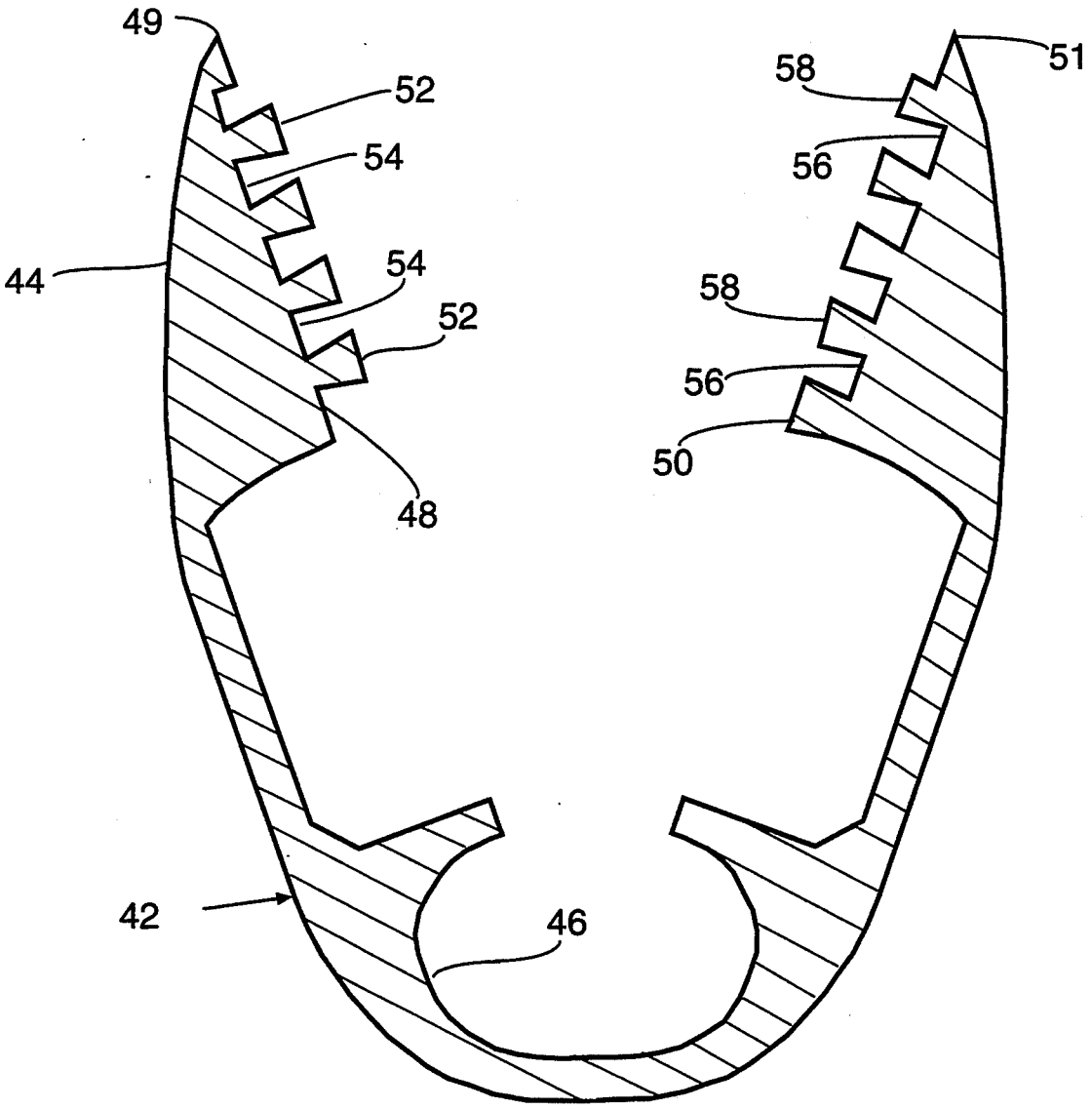
FIG. 3 is a cross section end view of an extruded plastic protective fairing for the hydrophone line array of FIGS. 1 and 2, according to the invention, shown in an open position.
Figure 4:
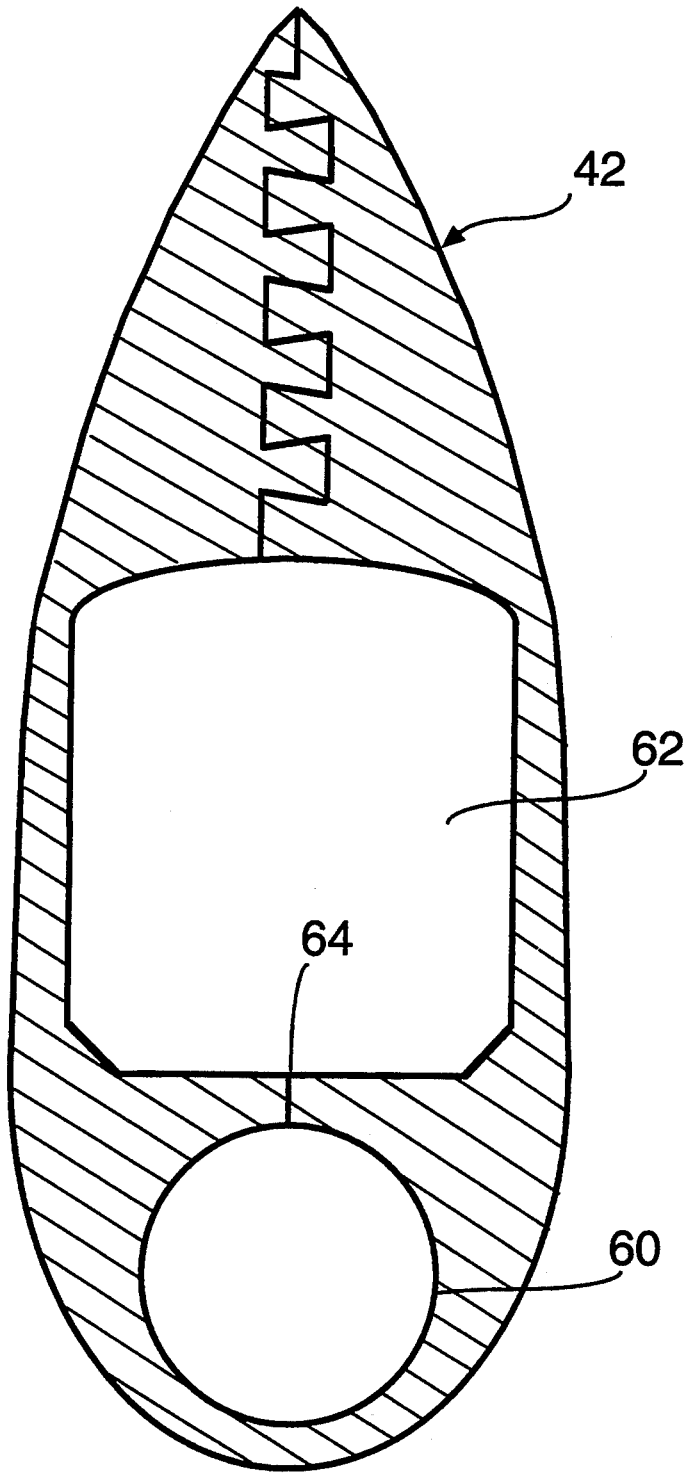
FIG. 4 is a cross section end view of the extruded plastic protective fairing for the hydrophone line array of FIGS. 1 and 2, shown in a closed position.

The protective cable fairing 42, shown in FIGS. 3 and 4, is designed to be used with the hydrophone line array 14 of FIGS. 1 and 2. The fairing 42 is formed as a single extrusion of plastic material having a smoothly curved outer surface 44 and an inner surface 46. The fairing 42 is assembled to the hydrophone line array 14 by folding one side 48 of the inner surface 46 about the cable 17 so as to engage an opposite side 50 of the inner surface 46 and join one fairing edge 49 with the opposite fairing edge 51.

The side 48 of the inner surface 46 includes a series of longitudinally-extending ridges 52 defining between the ridges 52 a like series of longitudinally-extending grooves 54. Similarly, the opposite side 50 of the inner surface 46 includes a series of longitudinally-extending grooves 56 which define between the grooves 56 a series of longitudinally-extending ridges 58. The ridges 52 on the side 48 are of complimentary shape to the grooves 56 on the side 50, and the grooves 54 on the side 48 are of complimentary shape to the ridges 58 on the side 50. The longitudinally-extending ridges 52 and 58 can be easily snapped into the corresponding longitudinally-extending grooves 56 and 54 to securely join the two sides 48 and 50 of the fairing inner surface 46, as shown in FIG. 4. When thus assembled, the inner surface 46 of the protective fairing 42 defines two longitudinally-extending passages, namely, a passage 60 of circular cross section for receiving the electromechanical cable 12, and a passage 62 of oblate cross section for receiving the cylindrical hydrophone protective housings 26. The passage 62 has an oblate cross section in order to accommodate the protective housing 26 when the faired sensor line assay is wound upon a take-up or storage drum.

Figure 5:
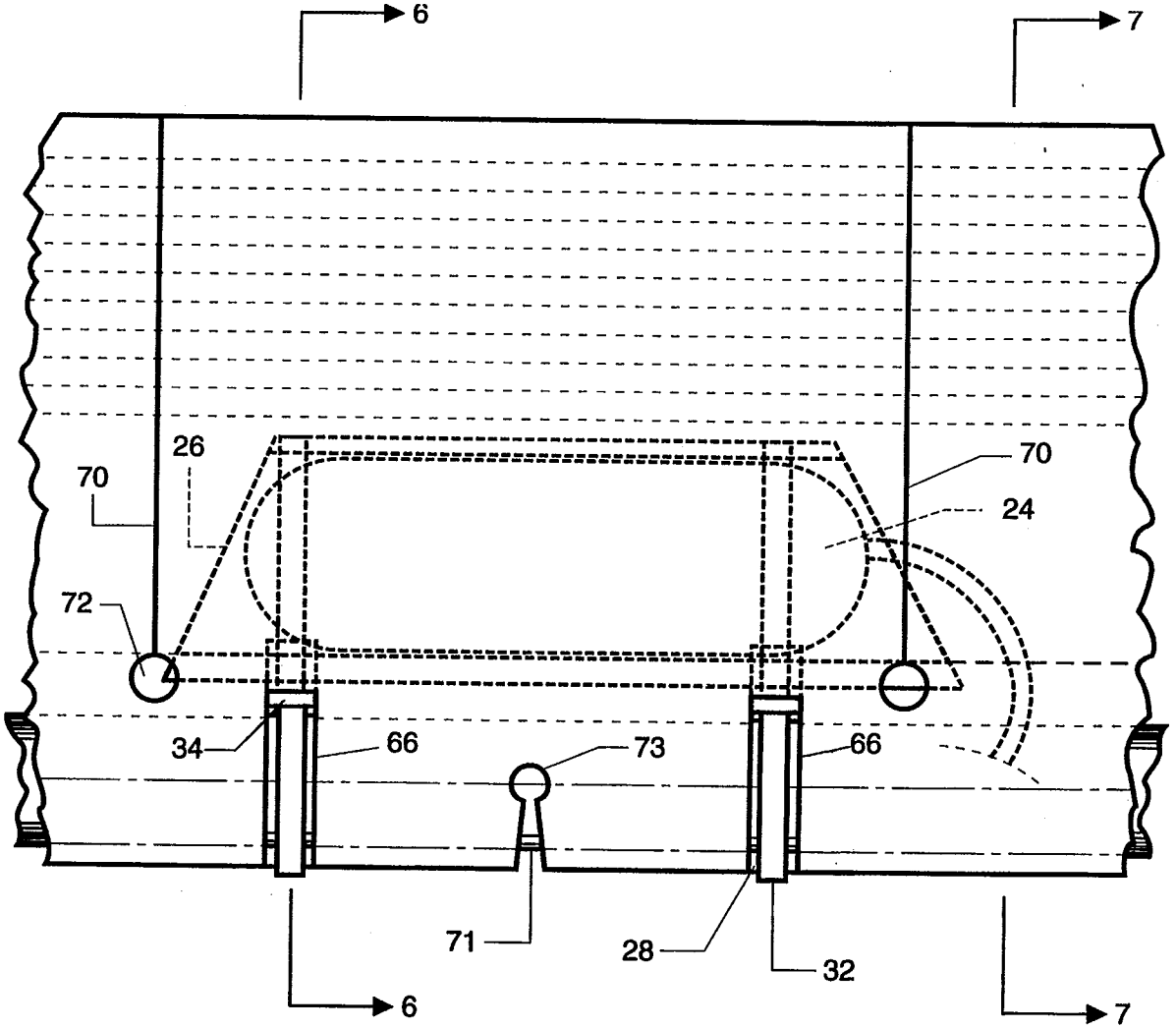
FIG. 5 is a side view of the fairing of FIG. 4, with the hydrophone line array of FIG. 1 encased therein.
Figure 6:
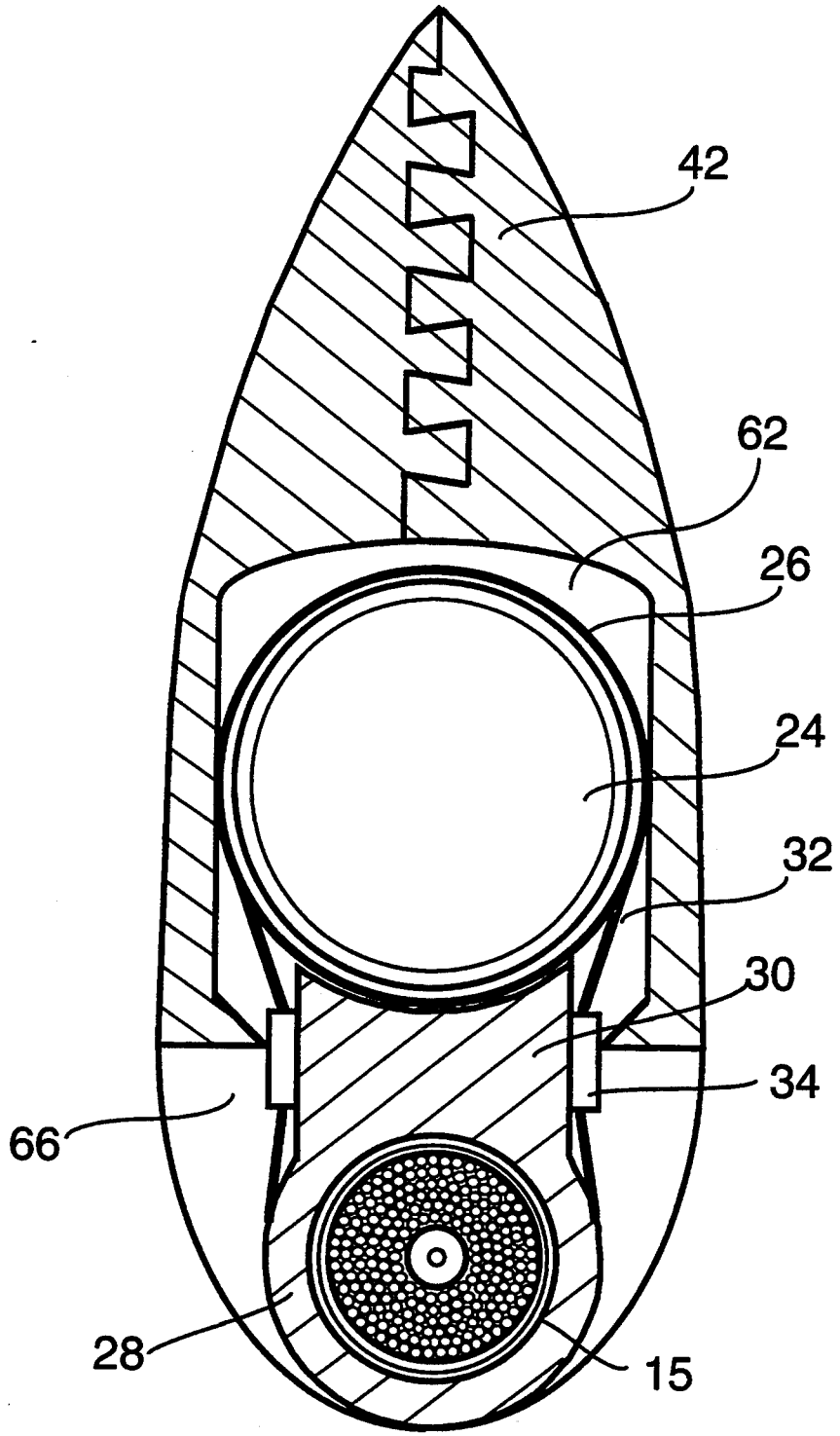
FIG. 6 is a cross section view of the fairing and hydrophone line array of FIG. 5, taken along the line 6—6 of FIG. 5.

During assembly of the protective fairing 42 on the hydrophone line array 10, a slot 66 is cut or stamped in the fairing 42 to accommodate the collar 28 molded about the cable 12, as shown in FIGS. 5 and 6. This slot 66 provides an opening to the sensor passage 62 to accommodate the saddle portion 30 of the collar 28 and the banding straps 32 and 34 which secure the hydrophone housing 26 to the cable 12. Also, the slot 66 and the molded cable collar 28 disposed therein prevent longitudinal movement of the cable 15 relative to the fairing 42.

Figure 7:
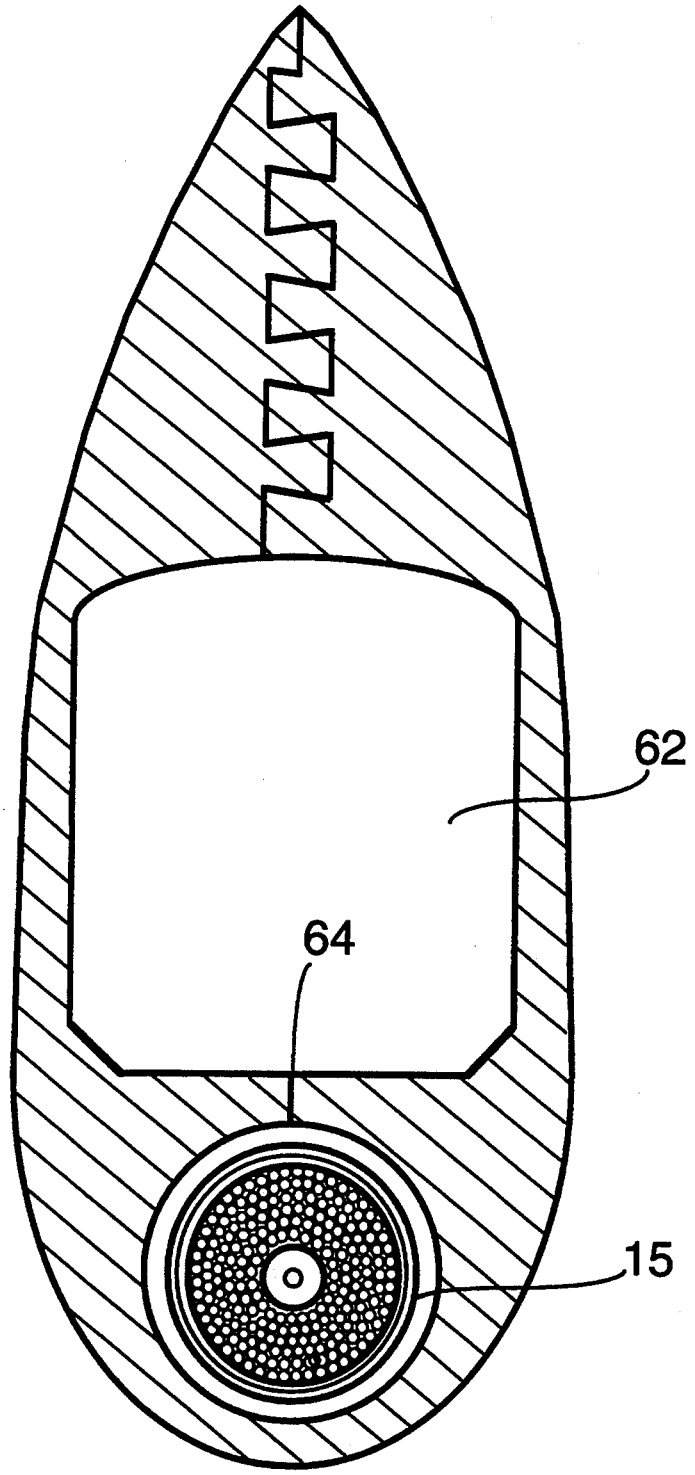
FIG. 7 is a cross section view of the fairing and hydrophone line array of FIG. 5, taken along the line 7—7 of FIG. 5.

After assembly of the protective fairing 42 on the hydrophone line array 10, the slit 64 between the passages 60 and 62 can be normally closed, as shown in FIG. 7. The fairing material is sufficiently elastic to accommodate the small insulated electrical conductors 36 and 38 connected to the hydrophone 24.

When the faired hydrophone line array 14 is wound on a storage drum, the portion of the protective fairing 42 which is radially inward of the electromechanical support cable 15 will be compressed and the portion of the protective fairing 42 which is radially outward of the support cable 15 will be stretched or elongated. These tensile forces on the fairing 42 when wound on a drum can be greatly reduced by a series of regularly spaced slits 70 extending inward from the trailing edge of the fairing 42, which open when the faired sensor line assay is wound on a drum. The compressive forces on the fairing 42 when wound on a drum can be greatly reduced by a series of regularly spaced V-shaped notches 71 in the leading edge of the fairing 42, which decrease or close when the faired sensor line array is wound on a drum. Both the slits 70 and the notches 71 terminate in respective holes 72 and 73 punched through the fairing 42 to provide local stress relief.

The protective fairing 42 may be formed from any of a variety of materials. Attributes which should be considered when selecting a material for the fairing 42 include density, characteristic acoustic impedance, elasticity, hardness, tensile strength, tear strength, ease of machining, water absorption, ultraviolet radiation resistance, and compatibility with extrusion processing. The fairing material density should be close to that of seawater, the fluid in which the sensor line array functions. The fairing material acoustic impedance (the product of the material's density and the speed of sound in the material) should be near that of seawater. However, in a low frequency regime where the thickness or bulk of the fairing material is small compared to the acoustic wavelength, a significant variation in the impedance from that of seawater can be tolerated without significantly affecting the measured acoustic signals.

One material which has been used in a prototype protective fairing for a hydrophone line array is a thermoset rubber compound marketed under the trade name SANTOPRENE® by the Monsanto Corporation, specifically, SANTOPRENE® Grade 201-73, which has a specific gravity of 0.98, hardness of durometer 73A, tensile strength of 1200 psi, and an ultimate elongation of 375%.

When a protective fairing is made for an existing unfaired sensor line array such as that described above, the cross section shape and size of the extruded fairing will vary, depending upon the diameter of the electromechanical cable, the size of most of the sensors attached to the cable, and the method of attachment. For example, the sensors may be lashed directly to the cable, in which case, the fairing may have only a single longitudinally-extending passage for receiving both the cable and the sensors attached to it, and a different method of preventing longitudinal or rotational movement of the cable relative to the fairing may be employed, such as securing the cable to the fairing by a strap which encircles the cable and part of the fairing, the strap extending about the leading edge of the fairing and through a stamped slot in the fairing on the back side of the cable.

Figure 8:
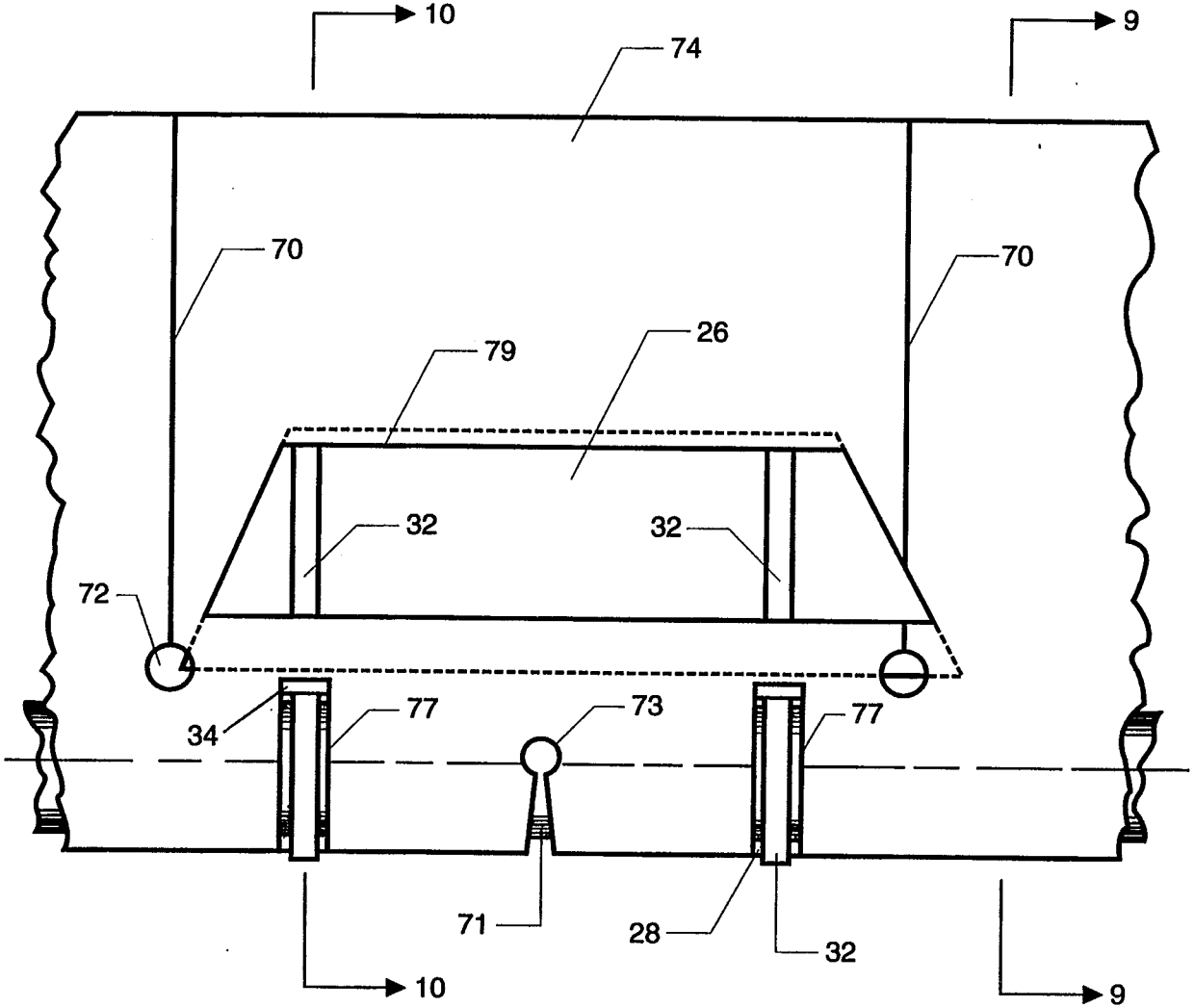
FIG. 8 is a side view of another fairing, according to the invention, with the hydrophone line array of FIG. 1 encased therein.
Figure 9:
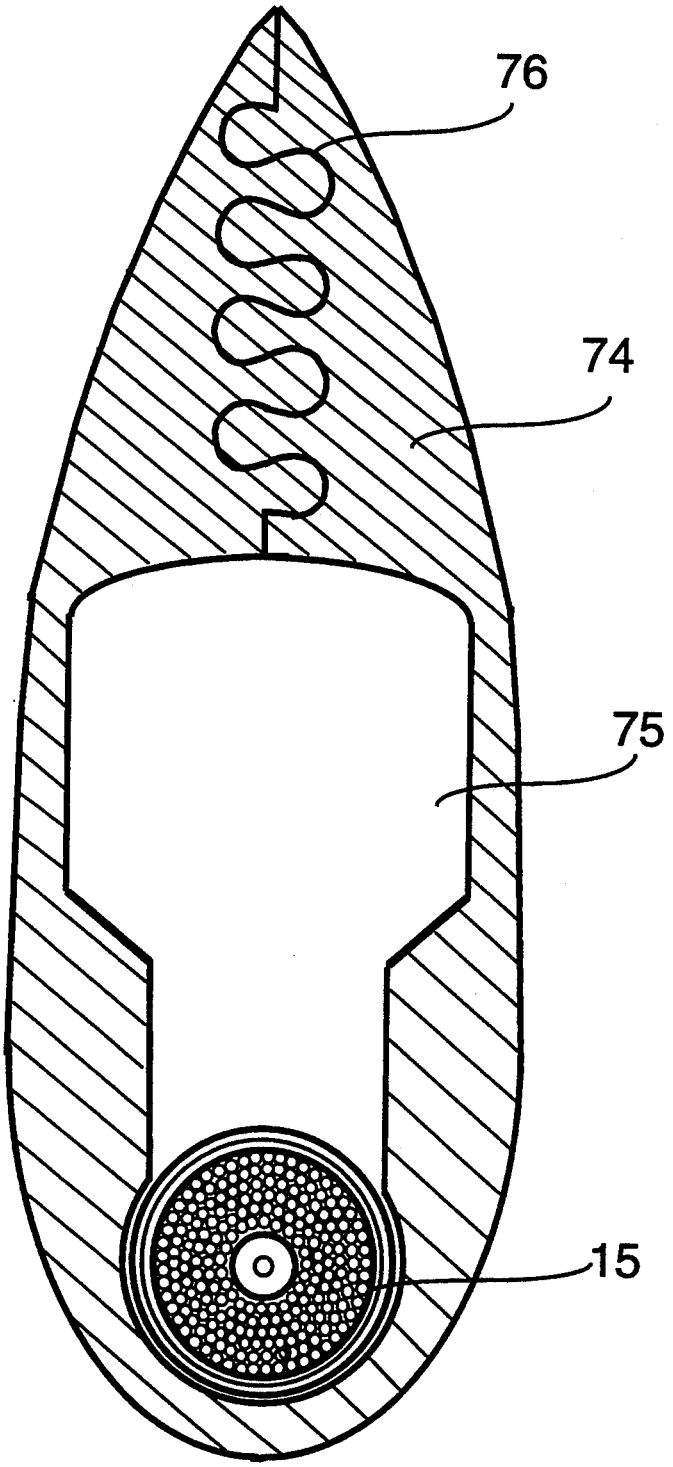
FIG. 9 is a cross section view of the fairing and hydrophone line array of FIG. 8, taken along the line 9—9 of FIG. 8.
Figure 10:
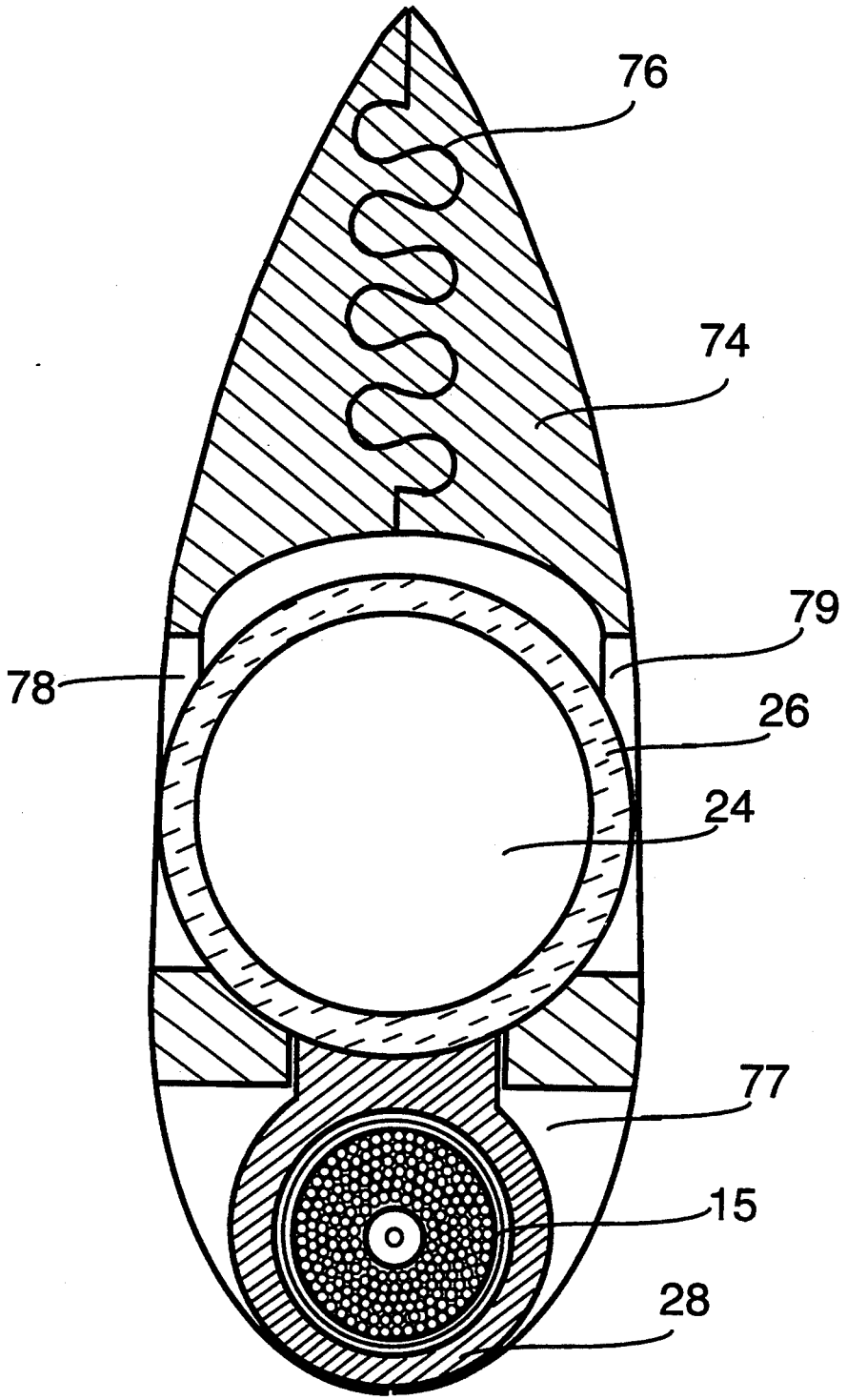
FIG. 10 is a cross section view of the fairing and hydrophone line array of FIG. 8, taken along the line 10—10 of FIG. 8.

The protective fairing 74, shown in FIGS. 8–10, is a variation of the protective fairing 42 described above, for use with the hydrophone line array 14 of FIGS. 1 and 2. The fairing 74 is essentially the same as the fairing 42, except (1) the fairing 74 only includes a single longitudinally-extending passage 75 for receiving both the electromechanical cable 15 and the sensors attached to it, (2) the two series 76 of complementary-shaped longitudinally-extending ridges and grooves are rounded or curved in cross section, and (3) the width of the assembled fairing 74 is somewhat less than that of the fairing 42 to minimize storage space requirements. During assembly of the protective fairing 74 on the hydrophone line array 14, slots 77 are cut or stamped on the fairing 74 to respectively accommodate the collars 28 molded around the cable 17, as shown in FIG. 10, and portions of the fairing sides adjacent the hydrophone housing 26 are removed, forming two slots 78, 79 into which the hydrophone housing 26 extends, as shown in FIG. 8 and 10. Thus, for a given line array storage drum, when the fairing 74 is used with the hydrophone line array 14 rather than the fairing 42, the drum will accommodate more turns of the fairing 74 than turns of the fairing 42. The slot 77 and the molded collar 28 disposed therein prevent longitudinal movement of the cable 15 relative to the fairing 74. Also, the slots 78, 79 prevent longitudinal movement of the hydrophone housing 26 relative to the fairing 74.

Essentially the same type of construction as shown for the hydrophone line array 14 and fairing 42 of FIGS. 1–7 can be used for a faired undersea sensor line array designed from scratch. In such an array, each of the cable collars for spacing and mounting the hydrophones to the cable can be shaped to completely fill the slot 66 to the original streamline profile, to minimize cable resistance and provide quieter acoustic performance in high current environments.

In a faired undersea hydrophone line array, since the fairing not only aligns the hydrophone line array for passage about rotating sheaves and winches but also provides shock and impact protection for the array hydrophones, the hydrophone protective housings can be eliminated. Also, the hydrophones and other sensors can be disposed and supported by the fairing, rather than the electromechanical cable, although longitudinal and rotational movement of the cable with respect to the fairing must still be limited.

The faired undersea hydrophone line array 80 shown in FIGS. 11–14 includes an electromechanical cable 82 similar to the cable 15 of FIG. 1, and a protective cable fairing 84 which is similar to the fairing 42 of FIGS. 3 and 4 in that it is formed as a single extrusion of the same plastic material as that of the fairing 42. Like the fairing 42, the fairing 84 is assembled by being folded about the cable 82 and securing the two trailing sides of the fairing 84 by snapping together two series 86 of complementary-shaped longitudinally-extending ridges and grooves. The assembled fairing 84, like the fairing 42, defines two longitudinally-extending passages, namely, a passage 88 of circular cross section through which the electromechanical cable 82 extends, and a passage 90 of oblate cross section for receiving cylindrical sensors, such as the hydrophone 92 connected to two insulated electrical conductors 94 and 96 of the cable 82. The slit 98 between the passages 88 and 90 can be normally closed, since the fairing material is sufficiently elastic to accommodate the electrical conductors 94 and 96. The passage 90 has an oblate cross section in order to accommodate the cylindrical hydrophone 92 when the faired sensor line assay 80 is wound upon a take-up or storage drum.

Like the fairing 42, the fairing 84 includes a series of regularly spaced slits 98 extending inward from the trailing edge of the fairing and a series of regularly spaced V-shaped notches 100 in the leading edge of the fairing 84. When the faired sensor line assay 80 is wound on a sheave or drum, the slits 98 open to greatly reduce tensile forces on the fairing 84 and the notches 100 close to greatly reduce compressive forces on the fairing 84. Both the slits 98 and the notches 100 terminate in respective holes 102 and 104, punched through the fairing 84 to provide local stress relief.

In the faired hydrophone line array 80, the hydrophones 92 are mounted to the fairing 84 rather than to the cable 82. The hydrophone 92 includes two cylindrical studs 106 and 108 extending radially in opposite directions from the cylindrical side of the hydrophone. The studs 106 and 108 extend respectively into holes 107 and 109 punched through the fairing 84, to secure the hydrophone 92 to the fairing 84 and prevent longitudinal movement of the hydrophone 92 within the passage 90 or rotational movement of the hydrophone 92 about the longitudinal axis of the hydrophone 92.

Figure 11:
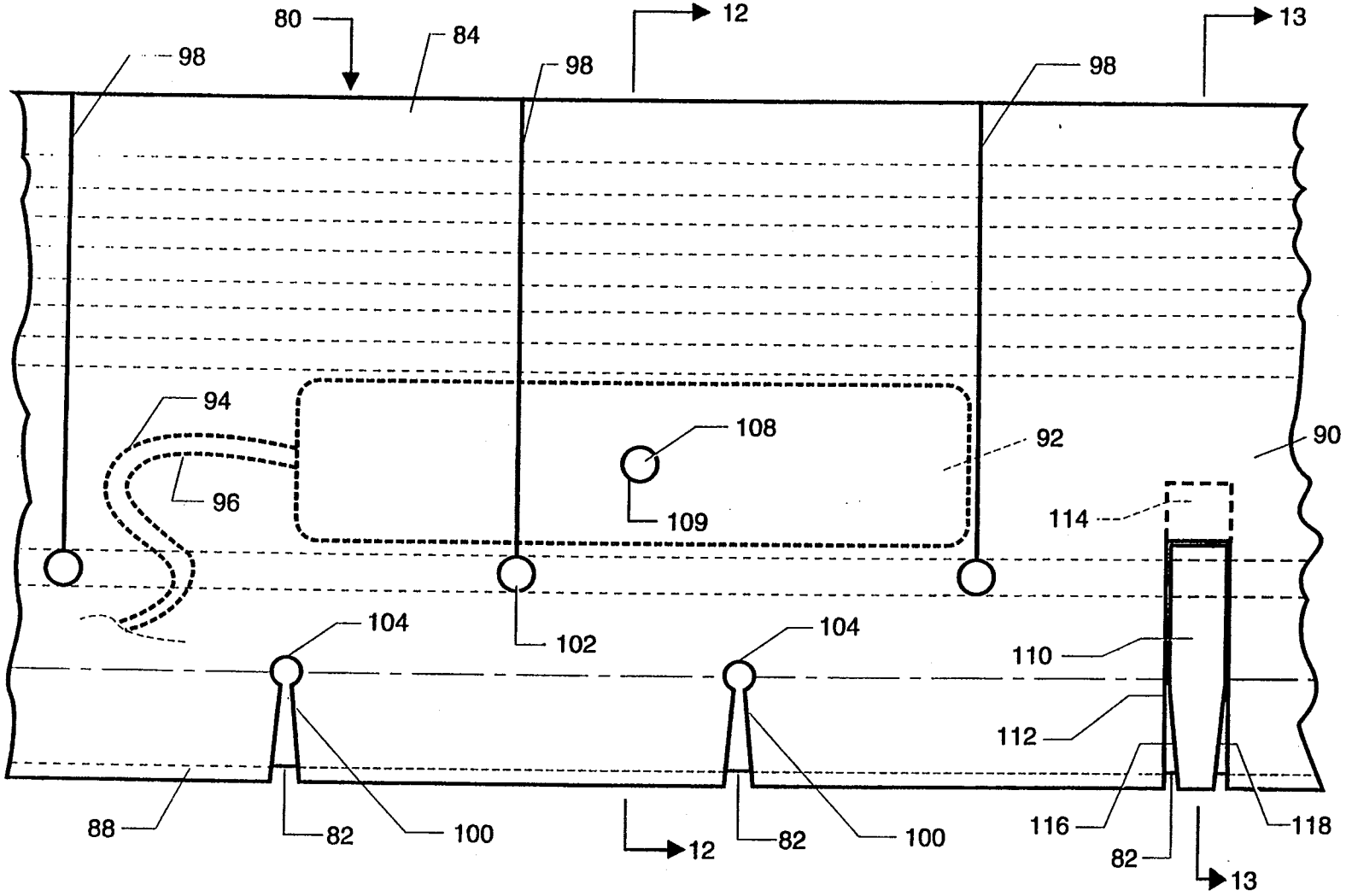
FIG. 11 is a side view of a portion of a faired undersea hydrophone line array, according to the invention, showing one of the hydrophones of the array encased therein.
Figure 13:
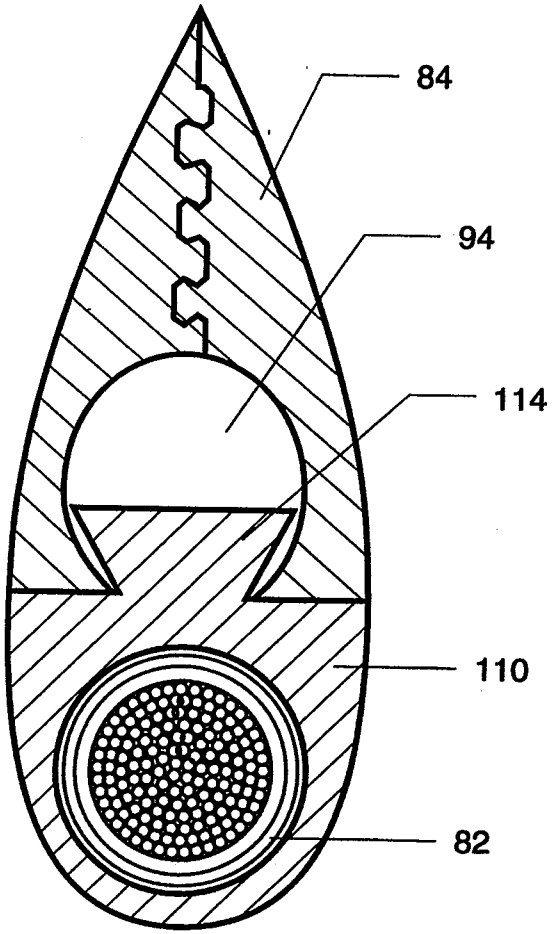
FIG. 13 is a cross section view of the faired hydrophone line array of FIG. 11, taken along the line 13—13 of FIG. 11.
Figure 14:
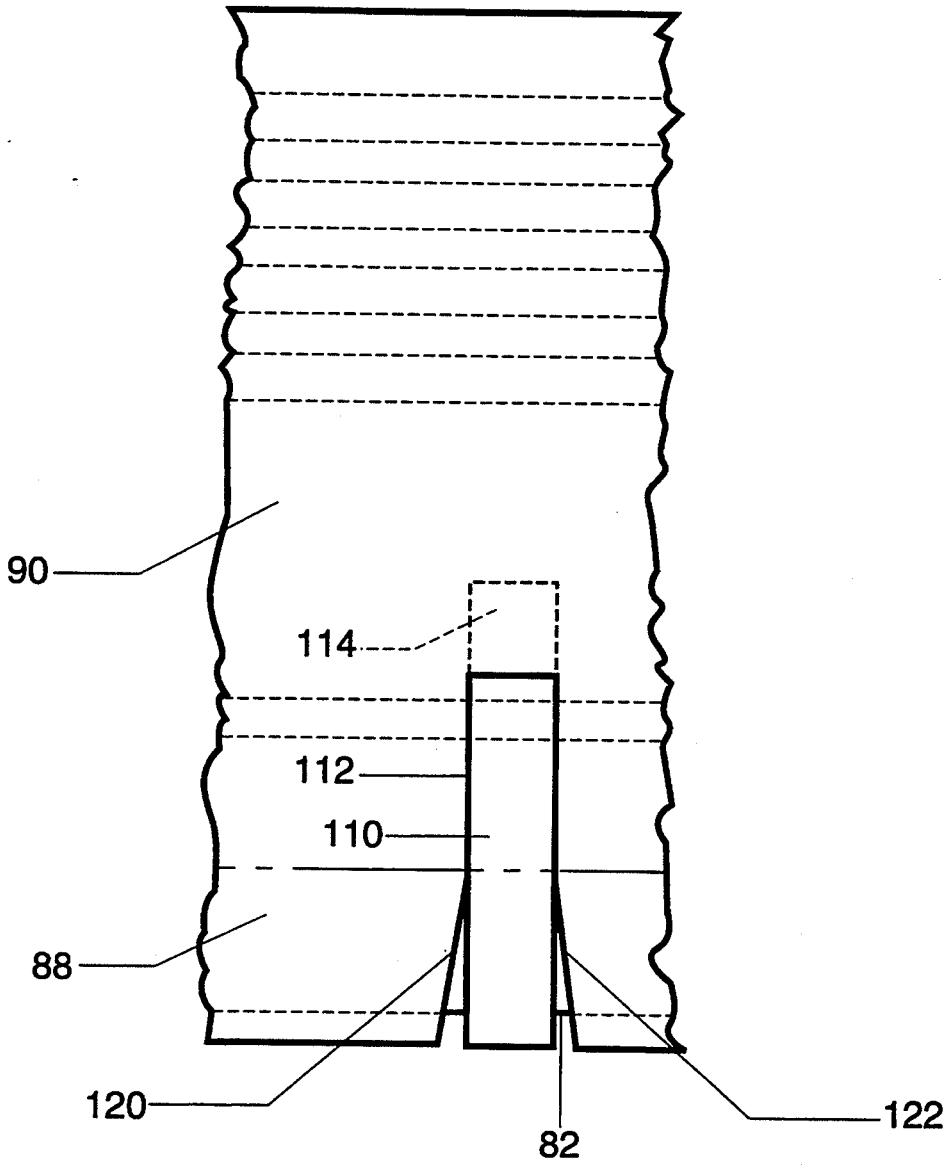
FIG. 14 is a side view of a portion of the faired hydrophone line array of FIG. 11, showing an alternate arrangement for securing the fairing to the electromechanical cable.

As seen in FIGS. 11 and 13, the cable 82 can be secured to the fairing 84 by a series of collars 110 molded about the cable 82 and a corresponding series of slots 112 cut or stamped in the fairing 84 to respectively accommodate the collars 110 and prevent longitudinal movement of the cable 82 within the passage 88. The collar 110 is shaped so as to have the same streamline profile in cross section as that of the adjacent uncut portion of the fairing 84, as shown in FIG. 13. The collar 110 has a tab portion 114 which extends into the passage 90 and against opposite sides of the passage 90 to prevent rotary movement of the cable 82 about its axis. Also, the collar 110 can also serve in place of one of the V-shaped notches 100 by beveling inward the sides 116 and 118 of the collar 110 within the slot 112 from the cable centerline to the leading edge of the fairing 84, as shown in FIG. 11. Conversely, the sides of the collar 110 within the notch 112 can be planar and parallel, and the slot 112 can serve in place of one of the V-shaped notches 100 by beveling outward the sides 120 and 122 of the slot 112 from the cable centerline to the leading edge of the fairing 84, as shown in FIG. 14.

Figure 15:
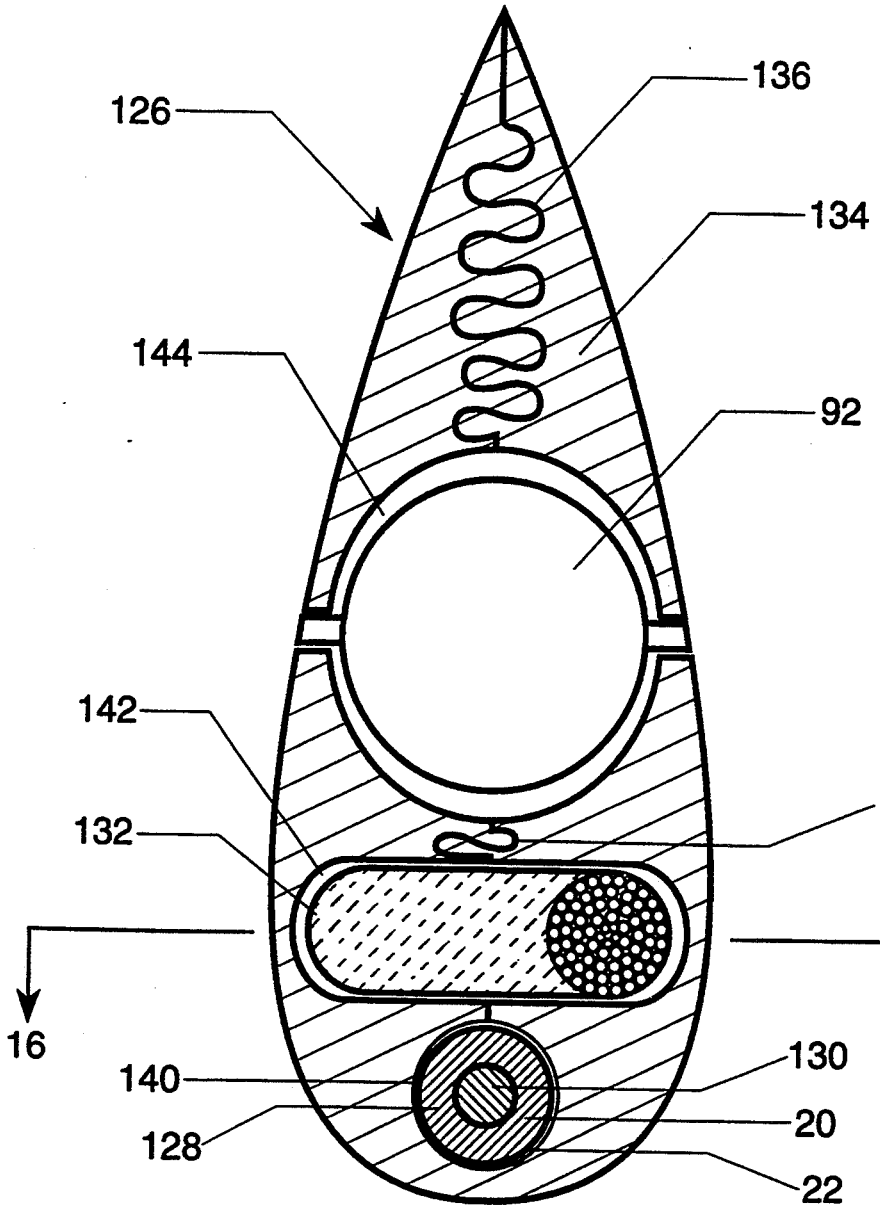
FIG. 15 is a cross section view of another faired undersea hydrophone line array, according to the invention, showing one of the hydrophones encased therein.
Figure 16:
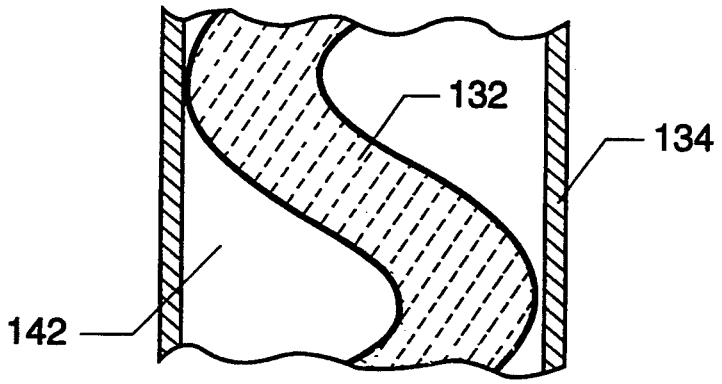
FIG. 16 is a cross section view of the faired hydrophone line array of FIG. 15, taken along the line 16—16 of FIG. 15.

In the faired undersea hydrophone line array 126 shown in FIGS. 15–16, the array support member is an electromechanical cable 128 which includes a coaxial telemetry cable 130 and braided layers of KEVLAR® fibers 20 surrounding the telemetry cable 130. The coaxial telemetry cable 130 is connected between a telemeter signal generating apparatus disposed at the lower end of the hydrophone line array and the surface ship, and the braided layers of KEVLAR® fibers 20 provide mechanical strength to support the hydrophone line array 126. The electromechanical cable 128 also includes an outer overbraid of DACRON® fibers 22 for abrasion resistance. The hydrophone line array 126 includes an array sensor cable 132 of individually-insulated electrical conductors for connecting each array sensor to the telemeter signal generating apparatus and a protective fairing 134 which is formed as a single extrusion of plastic material similar to that of the protective fairing 42, i.e., a plastic material having an acoustic impedance which is sufficiently close to that of seawater so that the fairing will not significantly affect the measured acoustic signals. The protective fairing 134 is assembled by being folded about the electromechanical cable 128, securing the two trailing sides of the fairing 134 by snapping together two series 136 of complementary-shaped longitudinally-extending ridges and grooves, and securing a central portion of the fairing by snapping together a pair 138 of complementary-shaped longitudinally-extending ridges and grooves. The assembled fairing 134 defines three longitudinally-extending passages, namely, a passage 140 of circular cross section through which the electromechanical cable 128 extends, a passage 142 of oblate cross section through which the array sensor cable 132 extends, and a passage 144 of oblate cross section for receiving cylindrical sensors, such as the hydrophone 92. Each hydrophone 92 is connected to two insulated electrical conductors of the array sensor cable 132 extending through an opening made between the two passages 142, 144 during assembly of the line array. The passage 144 has an oblate cross section in order to accommodate the cylindrical hydrophone 92 when the faired sensor line array 126 is wound upon a take-up or storage drum. Similarly, the passage 142 has an elongated cross section to allow a sinuous lay of the array sensor cable 132 with the passage 142 to allow stretching of the sensor cable 132 when the faired hydrophone line array 126 is wound upon a take-up drum.

Like the fairing 84 of the hydrophone line array 80 described above, the fairing 134 may include a series of regularly spaced slits (not shown) extending inward from the trailing edge of the fairing, which open to greatly reduce tensile forces on the fairing 134 when the faired hydrophone line array 126 is wound on a sheave or drum. The fairing 134 may also include a series of regularly spaced V-shaped notches in the leading edge of the fairing 134, which close to reduce compressive forces on the fairing 84 when the faired sensor line assay 126 is wound on a sheave or drum.

Figure 12:
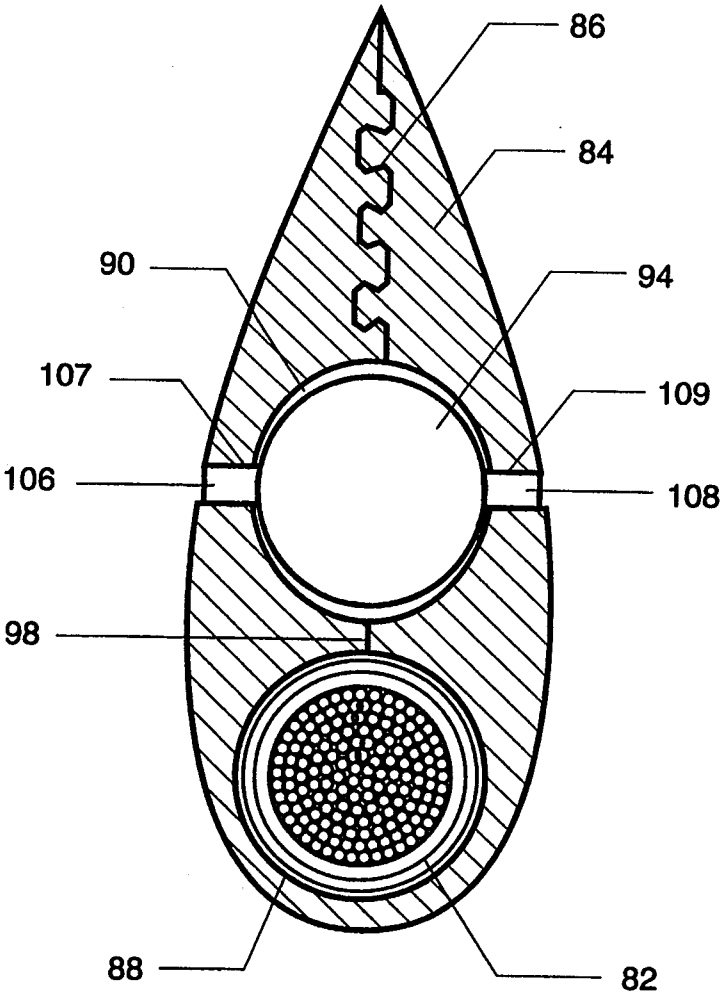
FIG. 12 is a cross section view of the faired hydrophone line array of FIG. 11, taken along the line 12—12 of FIG. 11.

In the faired hydrophone line array 126, the hydrophones 92 are mounted to the fairing 134 in the same way as described above for the hydrophones 92 of the faired hydrophone line array 80, and shown in FIGS. 11 and 12.

Since the hydrophones 92 and other array sensors are not affixed directly to the electromechanical cable 128, and since there are no direct electrical connections between the electromechanical cable 128 and either the array sensors or the array sensor cable 132, there is no need to prevent rotational or axial movement of the cable 128 relative to the array sensors or the array sensor cable 132. However, if desired, the electromechanical cable 128 can be secured to the fairing 134 by a series of collars molded about the cable 128 and a corresponding series of slots cut or stamped in the fairing 134 to respectively accommodate the collars and prevent longitudinal movement of the electromechanical cable 128 within the passage 140, in similar manner as described above for the faired hydrophone line array 80. The array sensor cable 132 may also be affixed to the fairing 134 at selected locations along its length by an adhesive, or by a collar and slot arrangement as described above.

Figure 17:
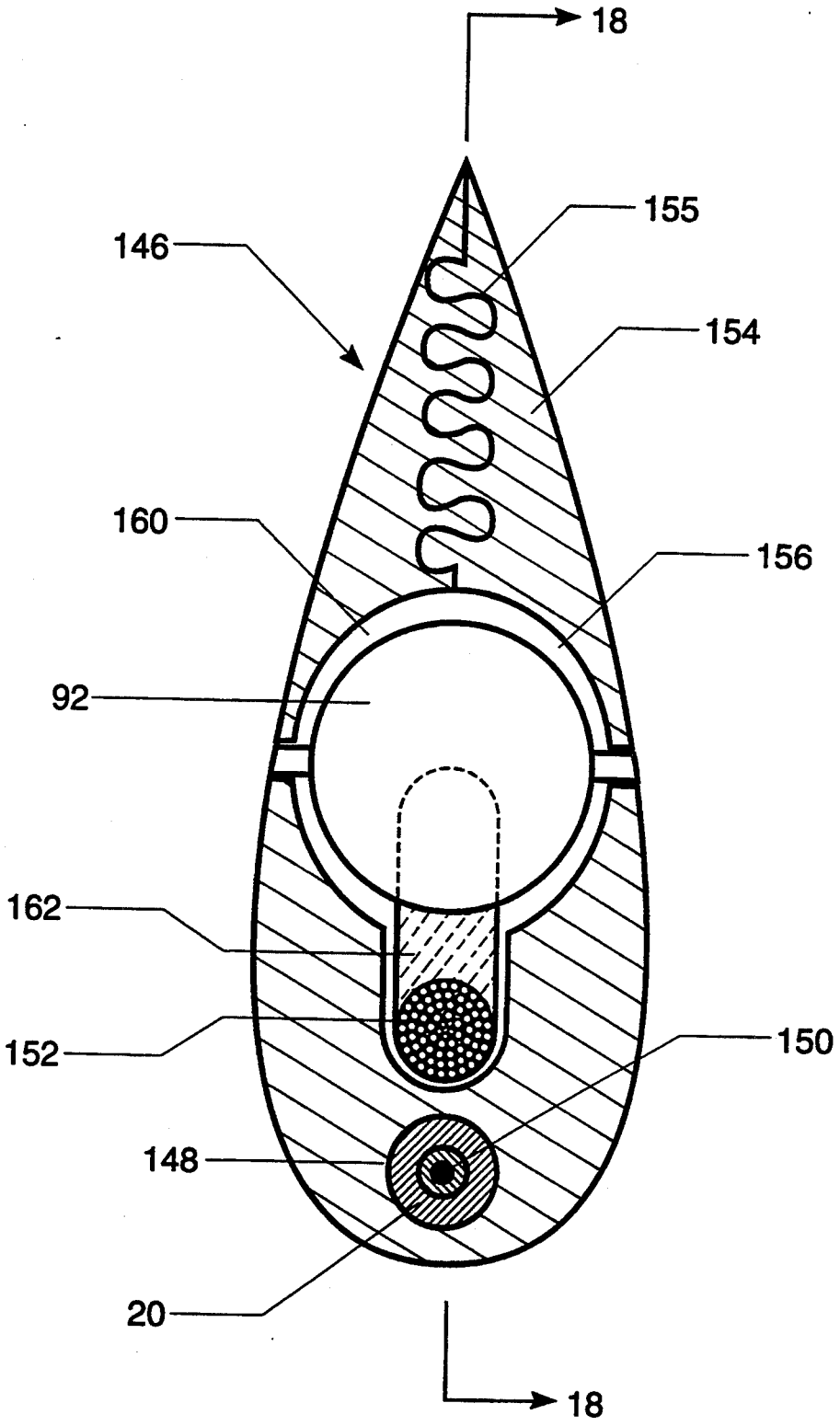
FIG. 17 is a cross section view of a third faired undersea hydrophone line array, according to the invention, showing one of the hydrophones encased therein.
Figure 18:
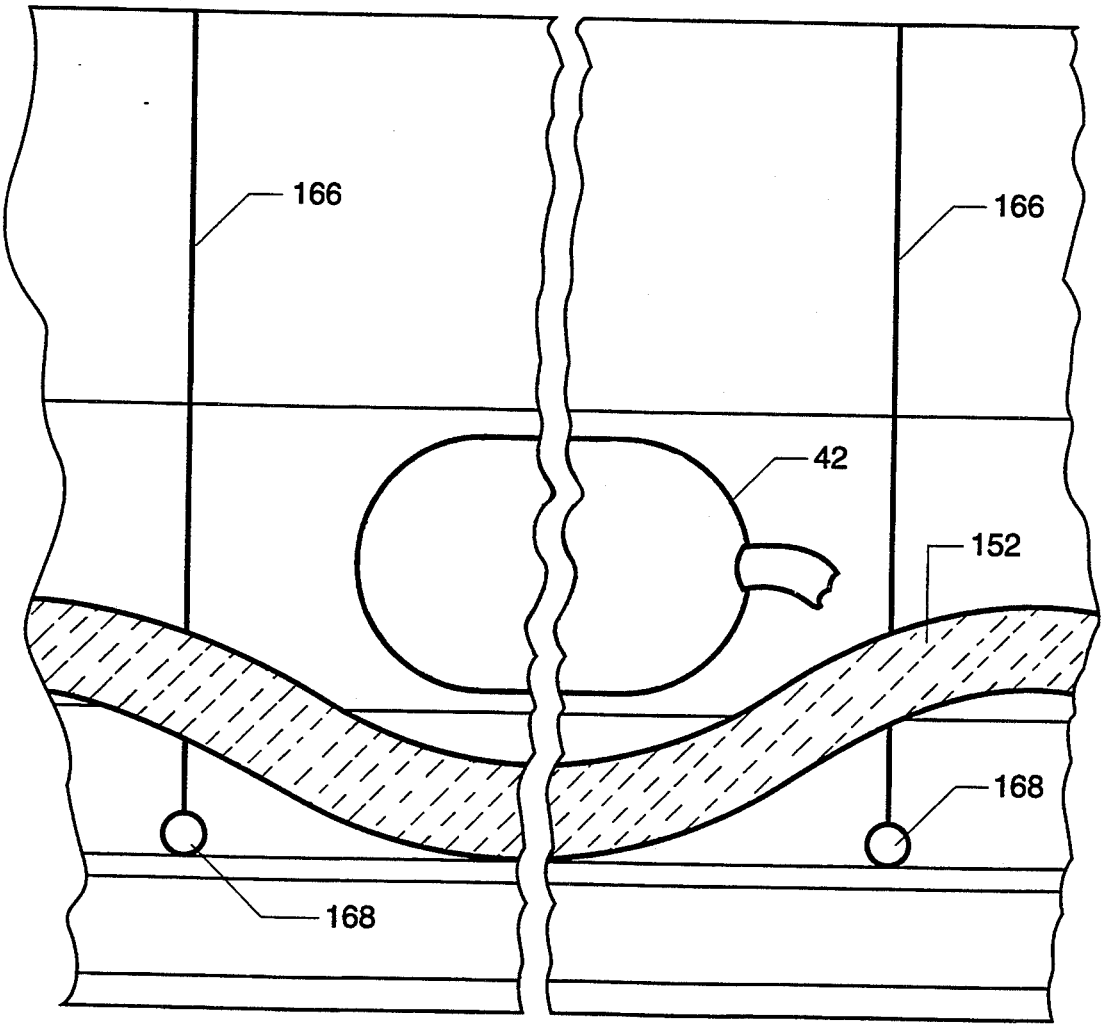
FIG. 18 is a cross section view of the faired hydrophone line array of FIG. 17, taken along the line 18—18 of FIG. 17.

In the faired undersea hydrophone line array 146 shown in FIGS. 17–18, the array support member is an electromechanical cable 148 which includes a coaxial telemetry cable 150 and braided layers of KEVLAR® fibers 20 surrounding the telemetry cable 150. The coaxial telemetry cable 130 is connected between a telemeter signal generating apparatus disposed at the lower end of the hydrophone line array and the surface ship, and the braided layers of KEVLAR® fibers 20 provide mechanical strength to support the hydrophone line array 146. The hydrophone line array 146 includes an array sensor cable 152 of individually-insulated electrical conductors for connecting each array sensor to the telemeter signal generating apparatus and a protective fairing 154 which is formed as a single extrusion of plastic material identical to that of the fairing 134, described above.

The electromechanical cable 148 is embedded in the protective fairing 154 at the time the fairing 154 is manufactured. Since the cable 148 is integral with the fairing 154, there is no need for the cable 148 to include an outer overbraid of DACRON fibers or the like for abrasion protection.

During assembly of the faired hydrophone line array 146, the two trailing sides of the fairing 154 are secured by snapping together two series 155 of complementary-shaped longitudinally-extending ridges and grooves, in the same manner as the protective fairing 42 described above. The assembled fairing 154 defines a single longitudinally-extending passage 156 through which the array sensor cable 152 extends, and within which cylindrical hydrophones 92 are affixed to the fairing 154, in identical manner as described above for the hydrophones 92 of the faired hydrophone line array 80. Each hydrophone 92 is connected to two insulated electrical conductors of the array sensor cable 132 during assembly of the line array. The passage 156 has a trailing end portion 160 of oblate cross section in order to accommodate the cylindrical hydrophone 92 when the faired sensor line array 146 is wound upon a take-up or storage drum, and a leading end portion 162 in the shape of a groove through which the array sensor cable 152 extends when it is adjacent the hydrophone 92. The elongated cross section of the passage 156 permits a sinuous lay of the array sensor cable 152 therein, as shown in FIG. 18, to allow stretching of the sensor cable 152 when the faired hydrophone line array 146 is wound upon a take-up drum. The array sensor cable 152 may be affixed to the fairing 154 at selected locations along its length by an adhesive, or by a collar and slot arrangement as described above, or by any other effective method.

The protective fairing 154 include a series of regularly spaced slits 166, which extend inward from the trailing edge of the fairing and terminate in respective holes 168 punched through the fairing 154 to provide local stress relief. These slits 166 open to greatly reduce tensile forces on the fairing 134 when the faired hydrophone line array 126 is wound on a sheave or drum.

Figure 19:
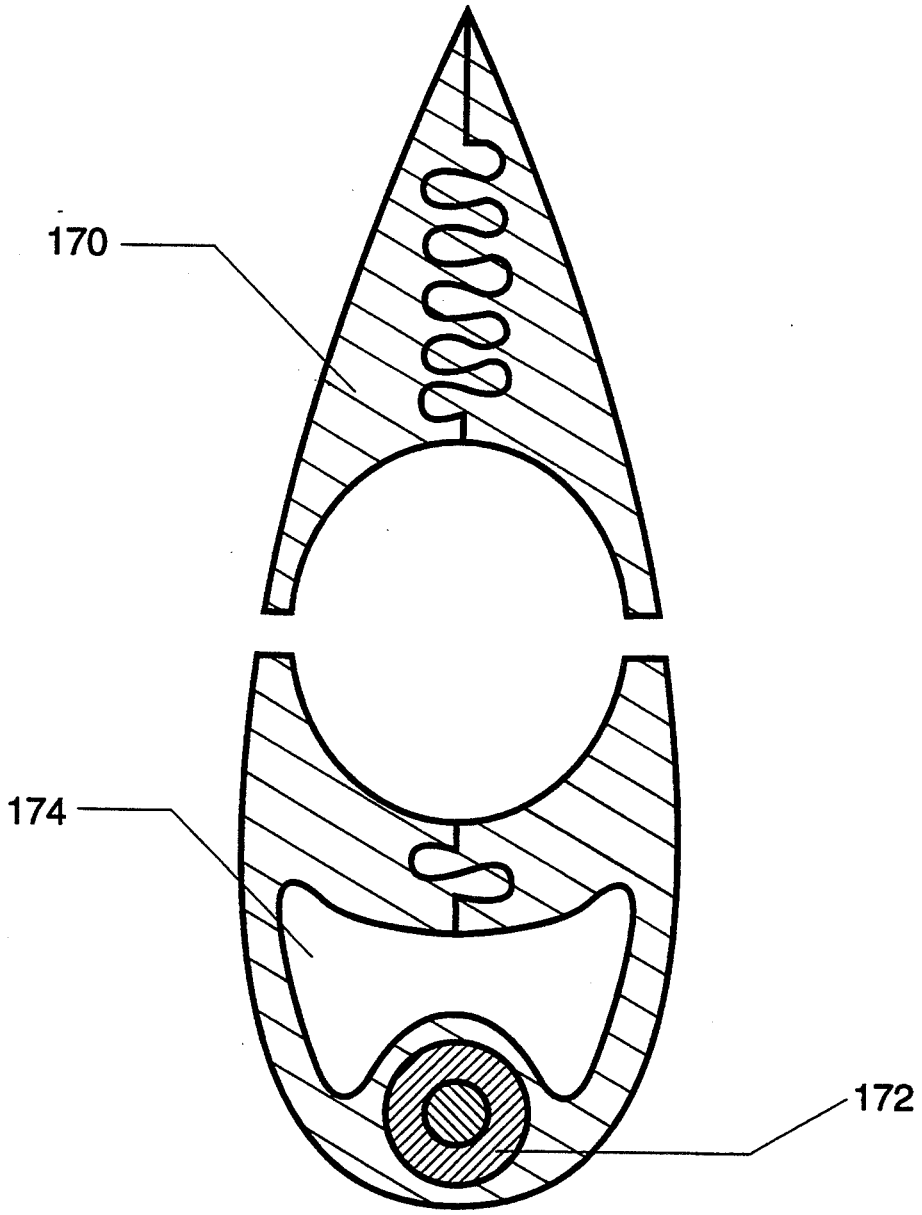
FIG. 19 is a cross section view of a protective fairing for an undersea hydrophone line array, which is a variation of the protective fairing for the faired hydrophone line array of FIG. 15.

The protective fairing 170 for an undersea hydrophone line array shown in FIG. 19 is basically the same as the protective fairing 134 described above except: (1) the circular passage 140 and electromechanical cable 128 of the fairing 134 is replaced by an integral electromechanical cable 172 identical to the integral electromechanical cable 148 of the protective fairing 154, also described above; and (2) the passage 142 of the fairing 134, through which the electrical conductors for the array sensors extend, is replaced by a longitudinally-extending passage 174 which conforms better than the passage 142 to the shape of the adjacent electromechanical cable 172, the passage 144 for the array sensors, and the adjacent outer surface of the fairing 170. The individually insulated electrical conductors 19 connecting the hydrophones and other array sensors to the telemeter signal generating apparatus may be disposed loose within the passage 174 rather than formed into an array sensor cable, so long as all conductors are sinuously laid, with sufficient slack so that no conductor will stretch and break when the hydrophone line array is wound about a sheave or onto a storage drum.

Since there are many modifications, variations, and additions to the specific embodiments of the invention described herein which will be obvious to one skilled in the art, it is intended that the scope of the invention be limited only by the appended claims.

What is claimed and desired to be secured by Letters Patent of the United States is:

1. A faired underwater sensor line array which can be repeatedly raised and lowered under tension from a ship and wound upon a storage drum on the ship without disassembly, comprising:

a longitudinally-extending support cable;

a plurality of longitudinally-spaced sensors, each generating an electric output signal;

signal transmitting means for transmitting the sensor output signals to the ship, including a plurality of insulated electrical conductors connected respectively to the plurality of sensors;

a continuous, longitudinally-extending fairing having a front leading edge and a back trailing edge, the fairing including at least one longitudinally-extending cavity for receiving the support cable, the sensors, and the insulated electrical conductors, the fairing being formed as a single extrusion of resilient plastic material having a longitudinally-extending center portion and opposite side portions, the center portion being folded longitudinally to define the fairing leading edge, the fairing including fastening means for fastening together the opposite side portions during assembly of the faired underwater sensor line array to define the fairing trailing edge and the at least one longitudinally-extending cavity, the support cable being disposed behind the leading edge of the fairing and the sensors being disposed behind said support cable; and restraint means for limiting motion of each sensor relative to the insulated electrical conductor connected to the sensor.

2. A faired underwater sensor line array, as described in claim 1, wherein the cavity for receiving the sensors has a cross section such that, when the faired sensor line array is wound upon the storage drum, the subsequent bending of the fairing about the drum will not cause a compressive force to be exerted by the fairing upon a sensor disposed within the cavity.

3. A faired underwater sensor line array, as described in claim 1, which further comprises fairing stress relief means for reducing forces acting on the fairing when the faired underwater sensor line array is wound on a drum with the fairing leading edge being adjacent the drum, the fairing stress relief means including a series of regularly spaced slits extending inward from the trailing edge of the fairing, which open when the faired underwater sensor line array is wound on the drum to reduce tensile forces on the fairing.

4. A faired underwater sensor line array, as described in claim 3, wherein the fairing stress relief means further comprises a series of regularly spaced V-shaped notches in the leading edge of the fairing, which decrease or close when the faired underwater sensor line array is wound on a drum to reduce compressive forces on the fairing.

5. A faired underwater sensor line array, as described in claim 1, wherein the support cable is an electromechanical cable which includes the plurality of insulated electrical conductors.

6. A faired underwater sensor line array, as described in claim 5, wherein the restraint means comprises:

sensor mounting means for limiting translational and rotational motion of the sensor relative to the protective fairing; and fairing mounting means for limiting translational and rotational motion of the fairing relative to the electromechanical cable.

7. A faired underwater sensor line array, as described in claim 6, wherein the sensor mounting means comprises:

the sensor, which has opposite sides extending between the fairing leading edge and the fairing trailing edge, each side including at least one mounting stud extending outward from the side; and the fairing, which includes at least one sensor mounting hole in opposite sides of the fairing adjacent the sensor, the number, location, size and shape of the sensor mounting holes being determined by the number, location, size and shape of the sensor mounting studs, so that each sensor mounting stud is received and secured within a corresponding sensor mounting hole of the fairing.

8. A faired underwater sensor line array, as described in claim 6, wherein the fairing mounting means comprises:

a collar, which is molded around the electromechanical cable and which includes a tab portion extending radially of the cable toward the trailing edge of the fairing; and the fairing, which includes a transverse slot cut through the fairing leading edge portion to receive said collar, the width of the slot corresponding to the width of the collar to limit longitudinal movement of the fairing relative to the electromechanical cable, and the depth of the slot being such that the tab portion of the collar extends into the adjacent longitudinally-extending cavity of the fairing, to limit rotational movement of the fairing about the electromechanical cable.

9. A faired underwater sensor line array, as described in claim 1, wherein the signal transmitting means comprises an array sensor cable which includes the plurality of insulated electrical conductors connected respectively to the plurality of sensors.

10. A faired underwater sensor line array, as described in claim 9, in which the fairing further comprises:

a first longitudinally-extending cavity of circular cross section, disposed within a leading edge portion of the fairing, for receiving the support cable;

a second longitudinally-extending cavity, disposed within an intermediate portion of the fairing, for receiving the array sensor cable, the cross section area of the second cavity being greater than the cross section area of the array sensor cable to allow a sinuous lay of array sensor cable therein;

a third longitudinally-extending cavity, disposed within a trailing edge portion of the fairing, for receiving the array sensors; and intermediate fastening means for fastening together opposite side portions of the fairing intermediate the second and third cavities of the fairing.

11. A faired underwater sensor line array, as described in claim 9, wherein:

the restraint means comprises sensor mounting means for limiting translational and rotational motion of the sensor relative to the protective fairing;

the support cable is integrally embedded in the fairing at the time the fairing is manufactured; and the fairing defines a single longitudinally-extending cavity for receiving the plurality of sensors and the array sensor cable which extends along one side of each sensor, the cross section of the cavity being such that, when the faired sensor line array is wound upon the storage drum, the subsequent bending of the fairing about the drum will not cause a compressive force to be exerted by the fairing upon a sensor or portion of the array sensor cable disposed within the bent portion of the cavity, the array sensor cable being disposed sinuously within the cavity in the portions of the cavity not containing a sensor.

12. A faired underwater sensor line array, as described in claim 1, wherein the support cable is an electromechanical cable which includes a coaxial telemetry cable and braided layers of high strength fibers surrounding the telemetry cable, the support cable being integrally embedded in the fairing at the time the fairing is manufactured.

13. A faired underwater sensor line array, as described in claim 12, wherein the fairing further comprises:

a first longitudinally-extending cavity, disposed within a leading edge portion of the fairing, for receiving the plurality of insulated electrical conductors connected respectively to the plurality of sensors;

a second longitudinally-extending cavity, disposed within a trailing edge portion of the fairing, for receiving the array sensors; and intermediate fastening means for fastening together opposite side portions of the fairing intermediate the first and second cavities of the fairing.

14. A faired underwater sensor line array, as described in claim 1, wherein the fairing fastening means comprises the two opposite side portions of the fairing adjacent the trailing edge, each of which includes a series of longitudinally-extending ridges which define between the ridges a like series of longitudinally-extending grooves, the ridges on one fairing side being of complimentary shape to the grooves on the other fairing side, and vice versa, so that the longitudinally-extending ridges of one fairing side can be easily snapped into the corresponding longitudinally-extending grooves of the other fairing side to fasten together the opposite side portions of the fairing adjacent the trailing edge.

15. A protective fairing which can be easily added to an existing unfaired undersea sensor line array to provide shock and impact protection to array sensors without significant degradation of sensor output and allow the sensor line array to be repeatedly raised and lowered under tension from a ship and wound upon a storage drum on the ship-without disassembly, wherein:

the existing unfaired undersea sensor line array comprises an array support cable, including a flexible strength member and a plurality of insulated electrical conductors, a plurality of array sensors, connected to respective pairs of the insulated electrical conductors, and a like plurality of sensor mounting means for respectively affixing the plurality of array sensors onto the array support cable, all of the array sensors having the same orientation and being disposed on the same side of the array support cable; and the protective fairing is a continuous, longitudinally-extending fairing having a front leading edge and a back trailing edge, the fairing defining at least one longitudinally-extending cavity for receiving the array support cable and the plurality of array sensors, the fairing being formed as a continuous extrusion of resilient plastic material having a longitudinally-extending center portion and opposite side portions, which is assembled by folding the extrusion longitudinally around the electromechanical cable and the plurality of array sensors and fastening together the opposite side portions adjacent the trailing edge, the array support cable being disposed behind the leading edge of the fairing and the plurality of sensors being disposed behind the array support cable, leading edge portions of the fairing being removed to accommodate the sensor mounting means, which also limit longitudinal and rotary movement of the fairing relative to the array support cable.

16. A protective fairing, as described in claim 15, wherein each of the opposite side portions of the fairing adjacent the trailing edge includes a series of longitudinally-extending ridges which define between the ridges a like series of longitudinally-extending grooves, the ridges on one fairing side being of complimentary shape to the grooves on the other fairing side, and vice versa, so that the longitudinally-extending ridges of one fairing side can be easily snapped into the corresponding longitudinally-extending grooves of the other fairing side to fasten together the opposite side portions of the fairing adjacent the trailing edge.

17. A protective fairing, as described in claim 15, in which the plurality of array sensors of the existing unfaired undersea sensor line array includes a large sensor having a maximum transverse dimension almost as great as the maximum transverse dimension of the fairing, whereby opposite side portions of the fairing adjacent the large sensor, which constitute opposite side wall portions of the longitudinally-extending cavity for receiving the array sensors, are removed during assembly of the protective fairing and the existing unfaired sensor line array, to accommodate the large sensor.

18. A protective fairing, as described in claim 15, which further comprises fairing stress relief means for reducing forces acting on the fairing when the faired underwater sensor line array is wound on a drum with the fairing leading edge being adjacent the drum, the fairing stress relief means including a series of regularly spaced slits extending inward from the trailing edge of the fairing, which open when the faired underwater sensor line array is wound on the drum to reduce tensile forces on the fairing.

19. A protective fairing, as described in claim 18, wherein the fairing stress relief means further comprises a series of regularly spaced V-shaped notches in the leading edge of the fairing, which decrease or close when the faired underwater sensor line array is wound on a drum to reduce compressive forces on the fairing.

20. A protective fairing, as described in claim 15, wherein the fairing cavity for receiving the array sensors has a cross section such that, when the faired sensor line array is wound upon the storage drum, the subsequent bending of the fairing about the drum will not cause a compressive force to be exerted by the fairing upon a sensor disposed within the cavity.

* * * * *